US007434304B2

(12) United States Patent
Owens

(10) Patent No.: US 7,434,304 B2
(45) Date of Patent: Oct. 14, 2008

(54) METHOD TO ASSEMBLE COMPONENTS USING BRACKETS AND BRACKETED ASSEMBLIES WITH BRACKET FURNITURE COMPONENTS

(75) Inventor: Larry Owens, Bonneville, MS (US)

(73) Assignee: Mobilis System, LLC, Jackson, MS (US)

( * ) Notice: Subject to any disclaimer, the term of this patent is extended or adjusted under 35 U.S.C. 154(b) by 142 days.

(21) Appl. No.: 11/534,150

(22) Filed: Sep. 21, 2006

(65) Prior Publication Data

US 2007/0011859 A1 Jan. 18, 2007

Related U.S. Application Data

(63) Continuation of application No. 10/919,537, filed on Aug. 17, 2004, now Pat. No. 7,252,339.

(60) Provisional application No. 60/503,124, filed on Sep. 15, 2003.

(51) Int. Cl.
*B23P 11/00* (2006.01)
*A47C 4/02* (2006.01)

(52) U.S. Cl. ..... 29/525.01; 29/525.02; 29/434; 29/428

(58) Field of Classification Search ..... 297/440.1, 297/440.16, 440.23; 248/224.61, 224.7, 248/224.8; 403/409.1; 312/111, 140, 263, 312/265.5; 29/525.01, 525.02, 525.03, 525.04, 29/434, 525, 428

See application file for complete search history.

(56) References Cited

U.S. PATENT DOCUMENTS 488,095 A * 12/1892 Scott et al. ..... 297/440.24
1,158,748 A 11/1915 Thulander
1,182,610 A 5/1916 Wiesman
2,452,642 A 4/1948 Ewing
3,030,146 A 4/1962 Faxon
3,403,641 A * 10/1968 Baker ..... 108/152
3,774,966 A 11/1973 Faulkner et al.
4,148,454 A 4/1979 Carlson et al.
4,234,976 A 11/1980 Litkewycz
4,459,920 A 7/1984 Cwick
5,080,438 A 1/1992 Moyer
5,551,757 A * 9/1996 Glover ..... 297/440.23
5,671,974 A 9/1997 Boycott et al.
5,775,778 A * 7/1998 Riley et al. ..... 297/440.1
6,241,317 B1 * 6/2001 Wu ..... 297/440.23
6,367,880 B1 * 4/2002 Niederman et al. .... 297/440.14
6,715,837 B2 4/2004 Niederman et al.
6,758,450 B2 * 7/2004 Niederman et al. ..... 248/200
6,827,407 B2 * 12/2004 Niederman et al. .... 297/440.14
6,942,298 B2 * 9/2005 Harrison ..... 297/440.1
7,252,273 B2 * 8/2007 Lewellen et al. ..... 248/300
7,252,339 B2 * 8/2007 Owens ..... 297/440.1
7,300,111 B2 * 11/2007 Huang ..... 297/440.16

* cited by examiner

*Primary Examiner*—Essama E. Omgba
(74) *Attorney, Agent, or Firm*—Butler, Snow, O'Mara, Stevens & Cannada PLLC

(57) ABSTRACT

Unique brackets, which form a bracket assembly that may be placed at any location of various components to form an assembly piece, such as furniture are disclosed. An assembled furniture piece made of furniture panels interconnected with attached engaging and receiving brackets is provided. The engaging and receiving brackets are positioned on components to facilitate the connection of the components. A method to assemble furniture having preformed arm, base, seat and back components is provided. This method of assembly saves on shipment costs, and facilitates the repair of damaged furniture.

4 Claims, 13 Drawing Sheets

METHOD TO ASSEMBLE COMPONENTS USING BRACKETS AND BRACKETED ASSEMBLIES WITH BRACKET FURNITURE COMPONENTS

RELATED APPLICATIONS

This application claims the benefit of prior provisional application Ser. No. 60/503,124 under 35 U.S.C. § 119(e) and U.S. patent application Ser. No. 10/919,537 under 35 U.S.C. § 120 hereby specifically incorporated by reference in their entirety

STATEMENT REGARDING NOT APPLICABLE FEDERALLY SPONSORED RESEARCH OR DEVELOPMENT

Not Applicable

REFERENCE A MICROFICHE APPENDIX

Not Applicable

FIELD OF THE INVENTION

This invention relates to ready-to-assemble components having brackets attached thereto and a method to use brackets to easily assemble components, such as furniture.

BACKGROUND OF THE INVENTION

Assembling furniture is ordinarily complicated. Present technology for assembling furniture is labor and part intensive. Presently, a piece of furniture will have many component parts and require several tools for assembly. Moreover, with present technology, assembly of furniture usually requires more than one person.

Other ready to assemble furniture systems utilize location dependent brackets that multiply the effort needed to assemble the furniture components and that intensify the complexity of the process.

Presently, most furniture is assembled by the seller because of the complexity of assembling. Thus, furniture is handled fully or most fully assembled which creates bulky cargo that takes up a considerable amount of space and is difficult to transport.

Additionally, when one part of a piece of furniture is damaged, the entire product must be returned instead of the damaged part. For example, when the frame of the arm of a couch is defective, the entire couch must be returned.

Regarding other ready-to-assemble furniture systems for furniture, all entail many component parts, are not stable and require considerable time to assemble. See e.g., Cwik U.S. Pat. No. 4,459,920 and Boycott, et al., U.S. Pat. No. 5,671,974.

BRIEF SUMMARY OF THE INVENTION

This invention further provides a method to assemble furniture having arm, base, seat and back components, which involves the steps of providing two arm components having a plurality of engaging and receiving brackets positioned to connect with corresponding brackets on another component; providing a base component having a plurality of receiving brackets positioned to connect with corresponding brackets on another component; providing a seat component with a plurality of brackets to connect with corresponding engaging brackets on another component; providing a back component with a plurality of engaging components to connect with corresponding receiving brackets on another component; connecting engaging brackets on the arm components with receiving brackets on the base component; connecting engaging brackets on the seat component with receiving brackets on the arm components; and connecting engaging brackets on the back component with receiving brackets on the arm components and the seat component.

DETAILED DESCRIPTION OF THE INVENTION

Figure 1:
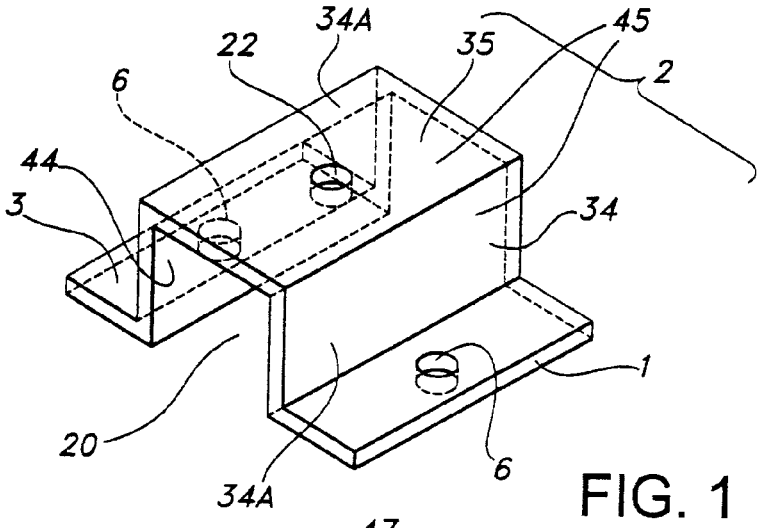
FIG. 1 is a schematic view of a receiving bracket.
Figure 2:
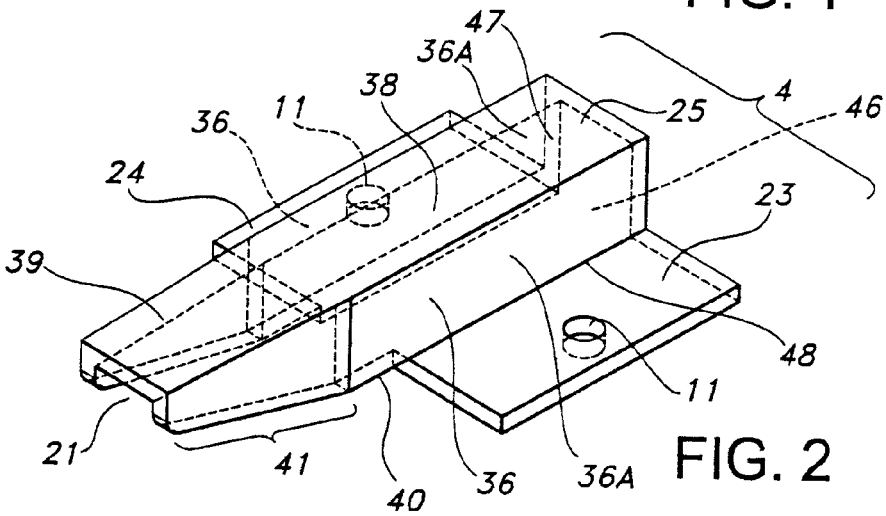
FIG. 2 is a schematic view of an engaging bracket.
Figure 3:
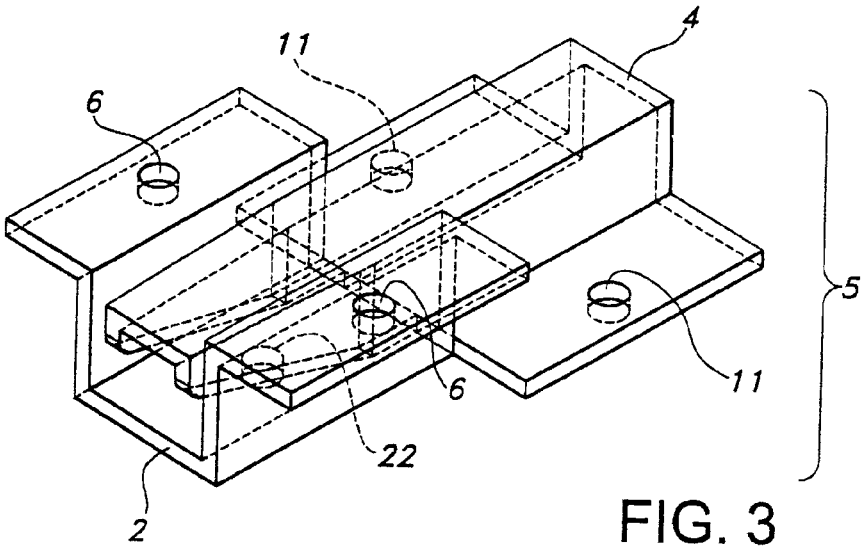
FIG. 3 is a schematic view of a bracket assembly.

Referring now to FIGS. 1-3, the bracket assembly 5 is made of a receiving bracket 2 and an engaging bracket 4. Now referring to FIG. 1, a receiving bracket 2 is made of a riser 34. The riser 34 has an inner surface 44 and an outer surface 45. The riser 34 may be straight, orthogonal, horizontal, sloped or curved. The riser 34 forms hollow internal section 20. The receiving bracket 2 also includes a plurality of flanges 1 and 3.

In the preferred embodiment, two coplanar parallel flanges 1 and 3 perpendicularly extend from the riser 34. In the preferred embodiment, two spaced apart vertical members 34A extend from a receiving top member 35 to form the riser 34. In this embodiment, the vertical riser 34A is straight and orthogonal. Receiving brackets 2 are preferably two and a half inches in width and two inches in length, but may be any size as desired by one skilled in the art. Receiving brackets 2 are preferably made of steel or iron although other materials, such as plastic or a synthetic modification thereof, may be used as desired by one skilled in the art. The engaging bracket 2 can be made integrally with a component.

In a preferred embodiment, the receiving bracket 2 is made of at least one planar flange 1 having an aperture 6 to receive an attachment means, such as a bolt, but other attachment means, such as spot welding or clamping, may be used as desired by one skilled in the art. At least one aperture 6 is preferably positioned in the center of each of the substantially parallel flanges 1 and 3 allowing for the receiving bracket 2 to be attached to a component (not shown in FIG. 1). A lock-down aperture 22 is positioned on the receiving bracket 2 to allow a locking means, such as a bolt, to contact the engaging bracket 4 to form a secure bracket assembly 5, but any other locking means may be used as desired by one skilled in the art. In this way, one bracketed component is interconnected with a second bracketed component.

Referring to FIG. 2, an engaging bracket 4 is made of an elongated riser 36 having an inner surface 46 and an outer surface 47. The elongated riser 36 may be straight, orthogonal, horizontal, sloped or curved. A plurality of flanges 23 and 24 perpendicularly extend from the elongated riser 36. The plurality of flanges 23 and 24 form a line of intersection 48 with the elongated riser 36. The elongated riser 36 is configured to extend beyond the plurality of flanges 23 and 24 to form a cantilevered projection 39. The cantilevered projection 39 is made of two portions. A first portion 40 and a second portion 41. In the first portion 40, the line of intersection 48 extends past the plurality of flanges 23 and 24 to form an outer surface sized to contact the inner surface 44 of the receiving bracket 2. Additionally, the cantilevered projection 39 has a second portion 41 which tapers and narrows where the line of intersection 48 has been cut away allowing for easy assembly of the engaging bracket 4 and receiving bracket 2.

In the preferred embodiment, two coplanar parallel flanges 23 and 24 extend from two spaced apart vertical members 36A. In the preferred embodiment, the two spaced apart vertical members 36A are straight and orthogonal. The spaced apart vertical members 36A extend from the engaging top member 38. The term riser can refer generically to a bracket having an external surface and a hollow internal section. More specifically, the terms two spaced apart vertical members refer to the preferred embodiment where the riser 36 is formed from two spaced apart members 36A and a top member 38.

Engaging top member 38 projects beyond at least one flange 23 to form a cantilevered projection 39. The cantilevered projection 39 has a tapered guide portion 41 to allow ease of initial assembly between engaging bracket 4 and receiving bracket 2. The cantilevered projection 39 is sized to fit, with minimal clearance in receiving bracket internal section 20. In the preferred embodiment, the engaging bracket 4 is made of at least one planar flange 23 having an aperture 11 to receive attachment means, such as a bolt. Any other attachment means, such as spot welding or clamping, may be used as desired by one skilled in the art. In the preferred embodiment, two coplanar parallel flanges 1 and 3 of the receiving bracket 2 off-set two coplanar parallel flanges 23 and 24 of the engaging bracket 4 upon assembly. Engaging brackets 4 are preferably two and a half inches in width and four inches in length but can be any size as desired by one skilled in the art. Engaging brackets 4 are made of steel or iron although other materials, such as plastic or a synthetic modification thereof, may be used as desired by one skilled in the art. The described shape of the receiving bracket 2 and engaging bracket 4 are constant but the overall size may change. The receiving bracket 2 can be integrally made with the component.

Now referring to FIG. 3, a bracket assembly 5 is shown. The bracket assembly 5 is formed of a receiving bracket 2 and an engaging bracket 4 which are placed in contact. The stability of the bracket assembly 5 is based upon contact between the outer surface 47 of elongated riser 36 of the engaging bracket 4 and the inner surface 44 of riser 34 of the receiving bracket 2. Additionally, the stability of the bracket assembly 5 is based on contact between the first portion 40 of the cantilevered projection 39 of the engaging bracket 4 with the inner surface 44 of the riser 34 of the receiving bracket 2. Additionally, the stability of the bracket assembly 5 can be based on contact between outer surface 45 of riser 34 of the receiving bracket 2 being in contact with the surface onto which the receiving bracket 2 is mounted.

Figure 4C:
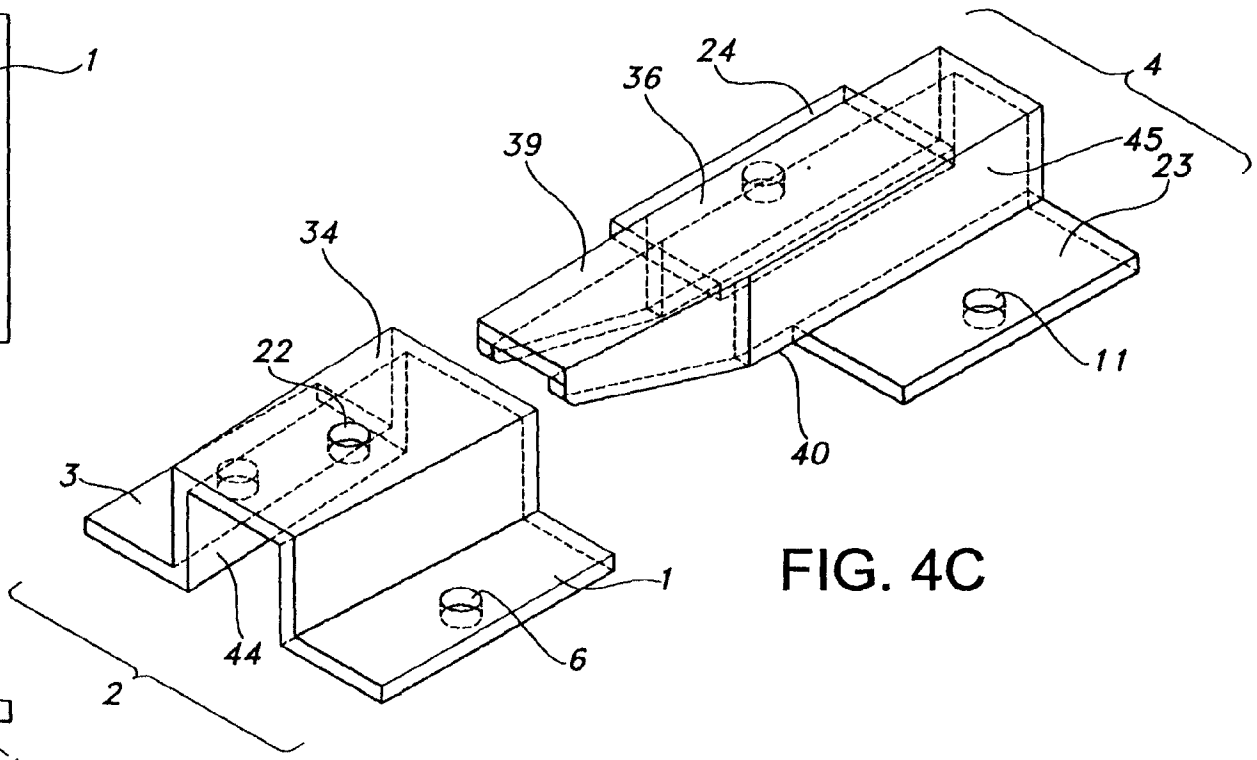
FIG. 4C is a schematic view of a receiving bracket and an engaging bracket.
Figure 4A:
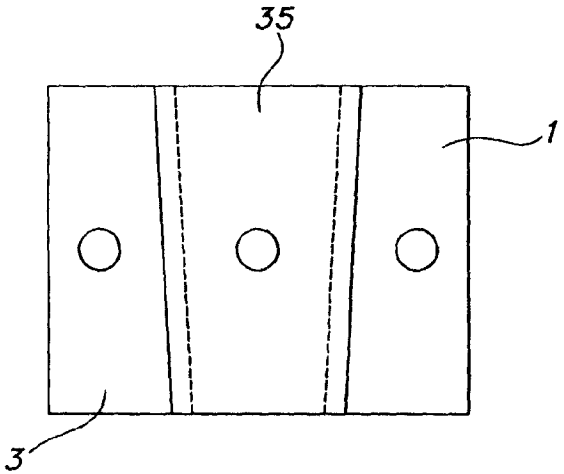
FIG. 4A is a schematic top view of a receiving bracket.
Figure 4B:
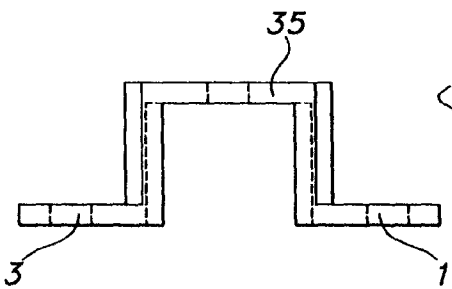
FIG. 4B is a schematic side view of a bracket assembly.

Now referring to FIGS. 4A-C, alternative engaging and receiving brackets are shown. The inner surface 44 and riser 34 of the receiving bracket 2 are sized to contact the outer surface 45 of the engaging bracket 4. In particular, the stability of the bracket assembly 5 is increased by the contact of the inner surface 44 of the receiving bracket 2 with the first portion 40 of the cantilevered projection 39 of the engaging bracket 4.

Additionally, the strength of the bracket assembly 5 can be increased by providing an interference fit between the receiving bracket 2 and engaging bracket 4. An interference fit occurs when the receiving bracket 2 is mounted on a material, such as wood. Wood will compress on the open side 20 of receiving bracket 2 to create a tight fit. Additionally, an interference fit occurs when the receiving bracket 2 is mounted to a material dissimilar to the engaging bracket 4 material. Similarly, a compressible layer of material, such as rubber can be placed between the receiving bracket 2 and the material to which the receiving bracket 2 is mounted.

Figure 5C:
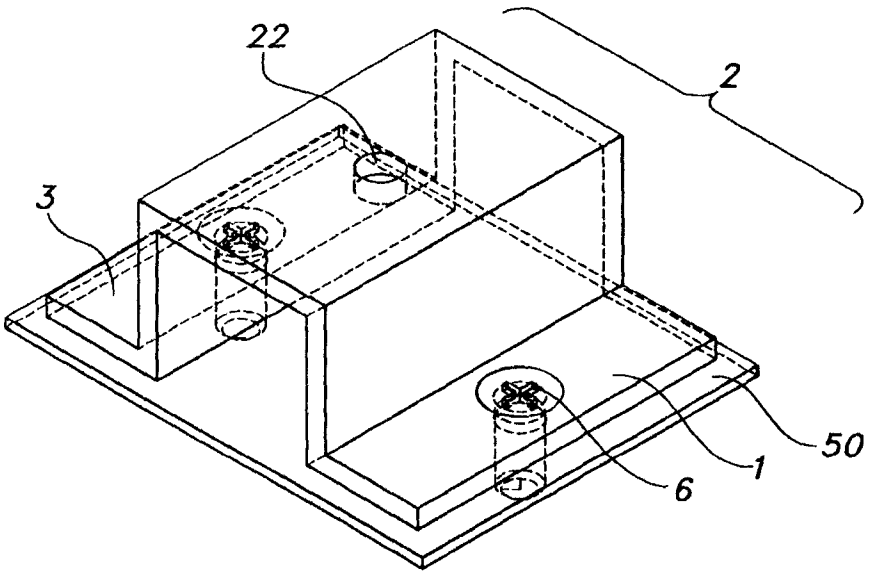
FIG. 5C is a schematic view of a receiving bracket and a compressible material.
Figure 5A:
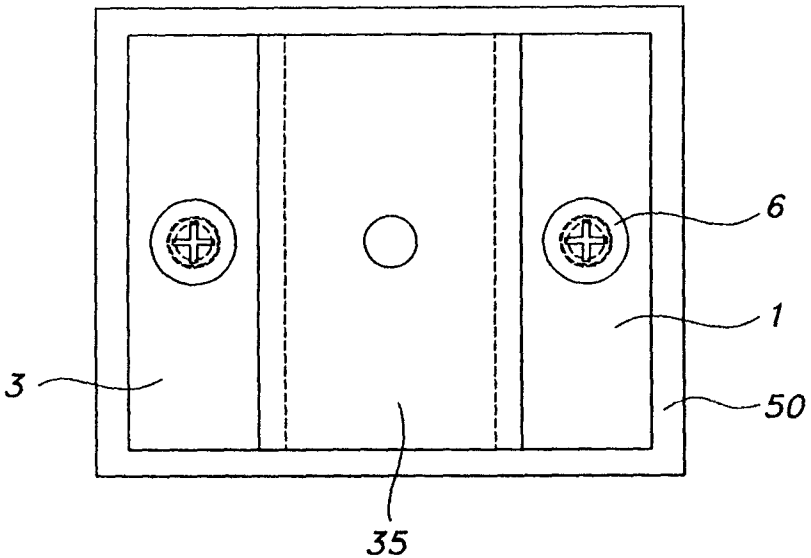
FIG. 5A is a schematic top view of a receiving bracket and a compressible material.
Figure 5B:
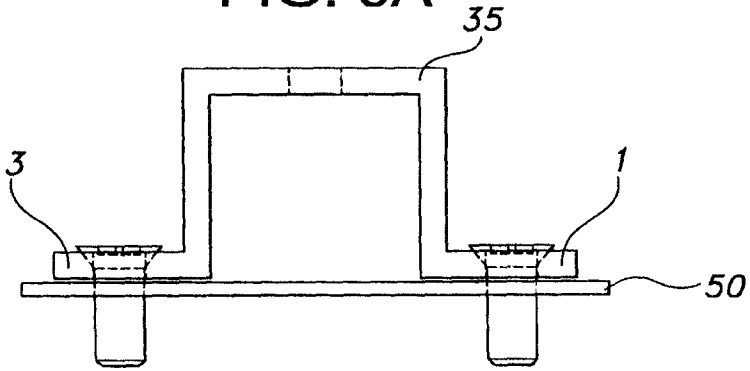
FIG. 5B is a schematic side view of a receiving bracket and a compressible material.

Now referring to FIGS. 5A-C, the interference fit can be enhanced by relying on the compressibility of the material onto which the receiving bracket 2 is mounted, such as wood. Wood will compress on the open side 20 of the receiving bracket 2 to create a tight fit. Similarly, a compressible layer of material 50 can be placed between the receiving bracket and the material onto which the receiving bracket 2 is mounted if the material to which the bracket is mounted, i.e., steel, has inadequate compressibility for this purpose.

The bracket assembly 5 is further strengthened by lock down aperture 22 wherein a locking means such as a bolt is used to secure the receiving bracket 2 to engaging bracket 4. Any other locking means may be used as desired by one skilled in the art. The lock down aperture 22 is positioned to allow a locking means, such as a bolt to contact the cantilevered portion 39 of engaging bracket 4.

The receiving bracket 2 and engaging bracket 4 are attached to panels which are formed into components. The components assemble to form furniture, signage and caskets. The terms "receiving" and "engaging" when used to describe a bracket refer to the shape of a bracket and not to the motion of the assembly process. A furniture component is at least one panel having at least one engaging or receiving bracket attached thereto. In a preferred embodiment, a furniture component is made of a plurality of panels. A furniture component is fixedly attached to another furniture component by forming bracket assemblies 5 between the furniture components. The furniture components with at least one engaging or receiving bracket are referred to as a bracketed furniture components. A furniture component is the basic building block of this system. Furniture will be shipped as bracketed furniture components.

Now referring to FIGS. 6A-9, the system and method to assemble a chair is shown. In this illustrative embodiment, the ready to assemble furniture piece 25 is made of five basic furniture components 10, 12, 14 and 16 including two opposing arm components 10, a base component 12, a seat component 14, and a back component 16. Depending on the styling of the furniture, more or less components can be used. These components are interconnected through receiving brackets 2 and engaging brackets 4 attached to the panels or made integrally with the panel. The bracketed furniture components 10, 12, 14 and 16 are preferably made of a plurality of furniture panels, such as 7, 8, 9, 13 and 14. A furniture component may be made of single panel as desired by one skilled in the art. A furniture panel is any part of the frame in which a bracket is attached, but not limited to wood; a panel can include other materials, such as steel and aluminum for example. Receiving brackets 2 and engaging brackets 4 are attached to the furniture components 10, 12, 14 and 16 in designated positions depending on the type and design of the ready to assemble furniture piece 25 desired. The brackets 2 and 4 are not location dependent. One skilled in the art may place the engaging brackets 4 and receiving brackets 2 at any location on the furniture components that allows for the furniture components to be interconnected by forming bracket assemblies 5. The brackets can be attached anywhere on the panels as long as they position interlock with a corresponding bracket on another component. The number, shape and size of the arm components 10, the base component 12, the seat component 14 and back component 16 will vary depending on the type and design of the ready-to-assemble furniture piece 25 desired. Also, the number of total bracket assemblies 5 used to interconnect furniture component will vary as desired by one skilled in the art. The number of receiving brackets 2 and engaging brackets 4 attached on the furniture panels 7, 8, 9, 13 and 15 will vary depending on the type and design of the ready-to-assemble furniture piece 25 desired.

A ready to assemble furniture piece 25 could be made of different bracketed components than those disclosed in this illustrative embodiment. For example, the bracketed component could be a table top, table leg, cabinet back, cabinet front, cabinet drawers, etc.

Figure 6A:
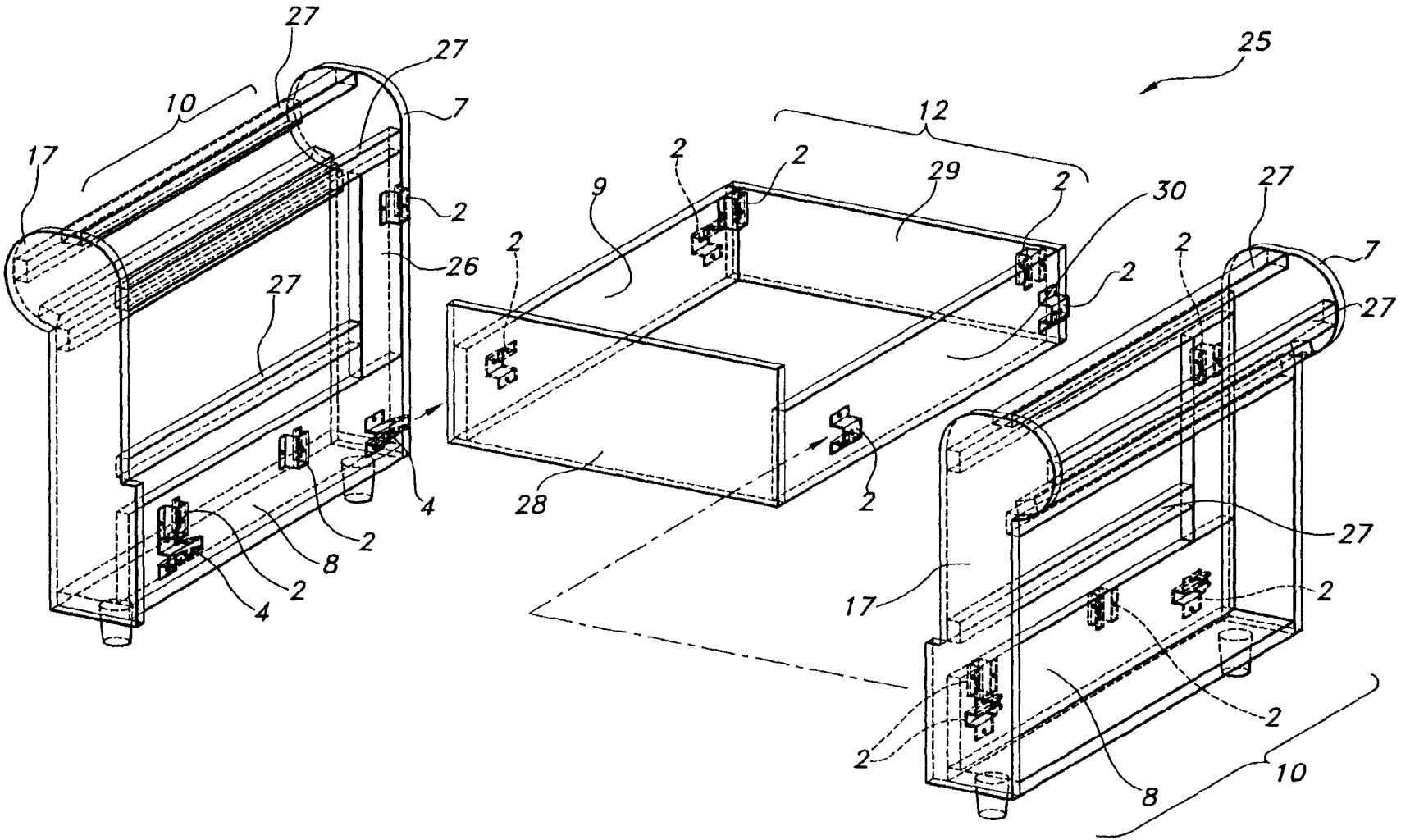
FIG. 6A shows a schematic view of the assembly process involving two arm components and a base component.

Referring to FIG. 6A, a portion of chair or small couch is shown. More specifically, two furniture arm components 10 are shown. The arm components 10 are made of differing materials and vary in size depending on the type and design of the ready to assemble furniture piece 25 desired. The arm component 10 is made of three major elements: a back side arm panel 7, a front side arm panel 17; and a side arm panel 8. A back side arm panel 7 includes a means to support a receiving bracket, such as a substantially perpendicular member 26. The receiving bracket 2 is attached by nails through aperture 6 to the perpendicular member 26, but other attachment means may be used as desired by one skilled in the art. The receiving bracket 2 of the back side arm panel 7 is preferably attached between the middle and top of the back side arm panel 7. The front side arm panel 17 is substantially parallel to the back side arm panel 7 and is connected to the side arm panel by a plurality of support members 27. The side arm panel 8 is substantially perpendicular to the back side arm panel 7 and front side arm panel 17, and is connected to both. The side arm panel has a plurality of receiving brackets 2 and a plurality of engaging brackets 4 attached thereto. The brackets are positioned to connect with corresponding brackets on another furniture component to form a bracket assembly. A bracket assembly can be strengthened by applying an adhesive, bolt or screw to lock down aperture 22. The base component 12 is made of a first side base panel 9 and a second side base panel 30. The base component 12 is also made of a front base panel 28 and a rear base panel 29. The first side base panel 9 and second side base panel 30 has an interior and exterior surface to which engaging brackets 4 and receiving brackets 2 are attached.

Figure 6B:
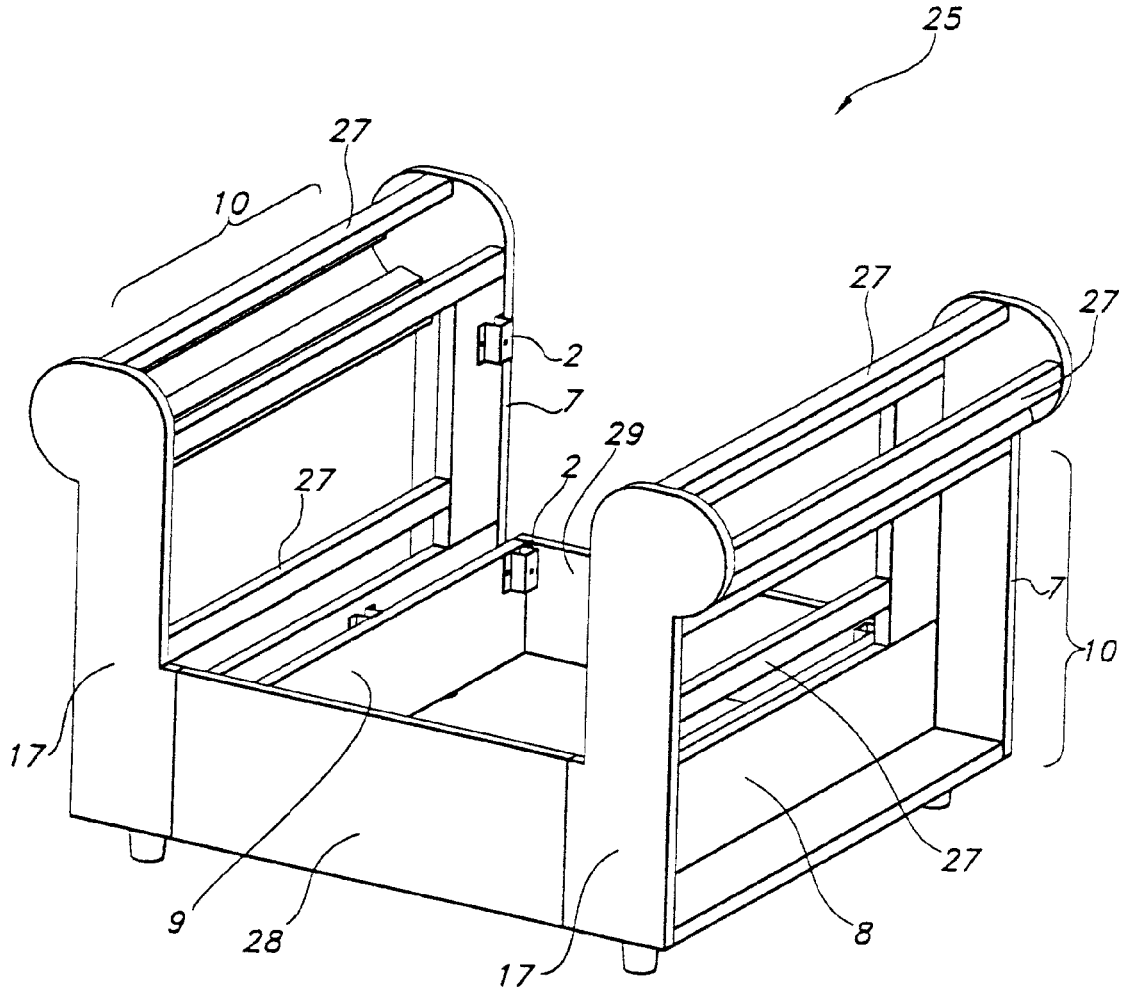
FIG. 6B shows the result achieved by the assembly of two arm components and a base component.

FIG. 6B depicts the result achieved by the assembly of two opposing arm components and a base component 12. More specifically, two arm components 10 are contactingly moved adjacent to base component 12. A plurality of engaging brackets 4 attached to the horizontal side arm panel 8 are inserted into receiving brackets 2 on the exterior surface of the first side base panel 9 and second side base panel 30 of the base component 12.

Figure 7A:
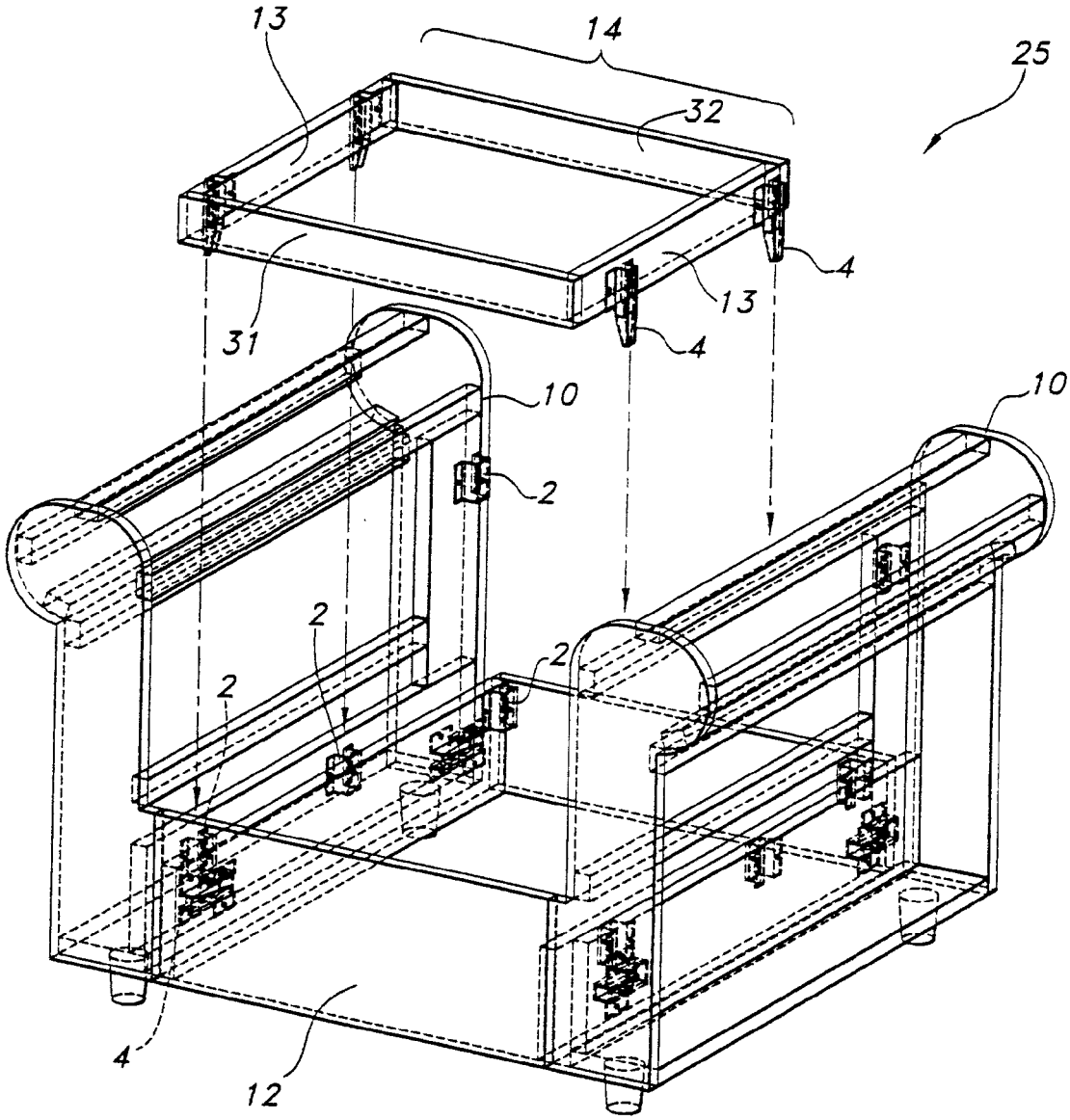
FIG. 7A shows a schematic view of the assembly process involving the seat component and the result in FIG. 6B.

Referring to FIG. 7A, the seat component 14 is made of a first and second side seat panels 13. A plurality of engaging brackets 4 are vertically mounted on the exterior of each side seat panel 13. In the preferred embodiment, two sets of engaging brackets 4 are attached near the front and rear sections of the side seat panels 13 allowing for the seat component 14 to lock with the arm components 10 upon assembly. The seat component 14 also includes a front seat panel 31 and rear seat panel 32. The seat panels 13, 31 and 32 are interconnected at right angles to form a frame. The receiving brackets 2 on the horizontal side arm panel 8, and arm component 10 are positioned to receive engaging bracket 4 on side seat panel 13 of seat component 14.

Figure 7B:
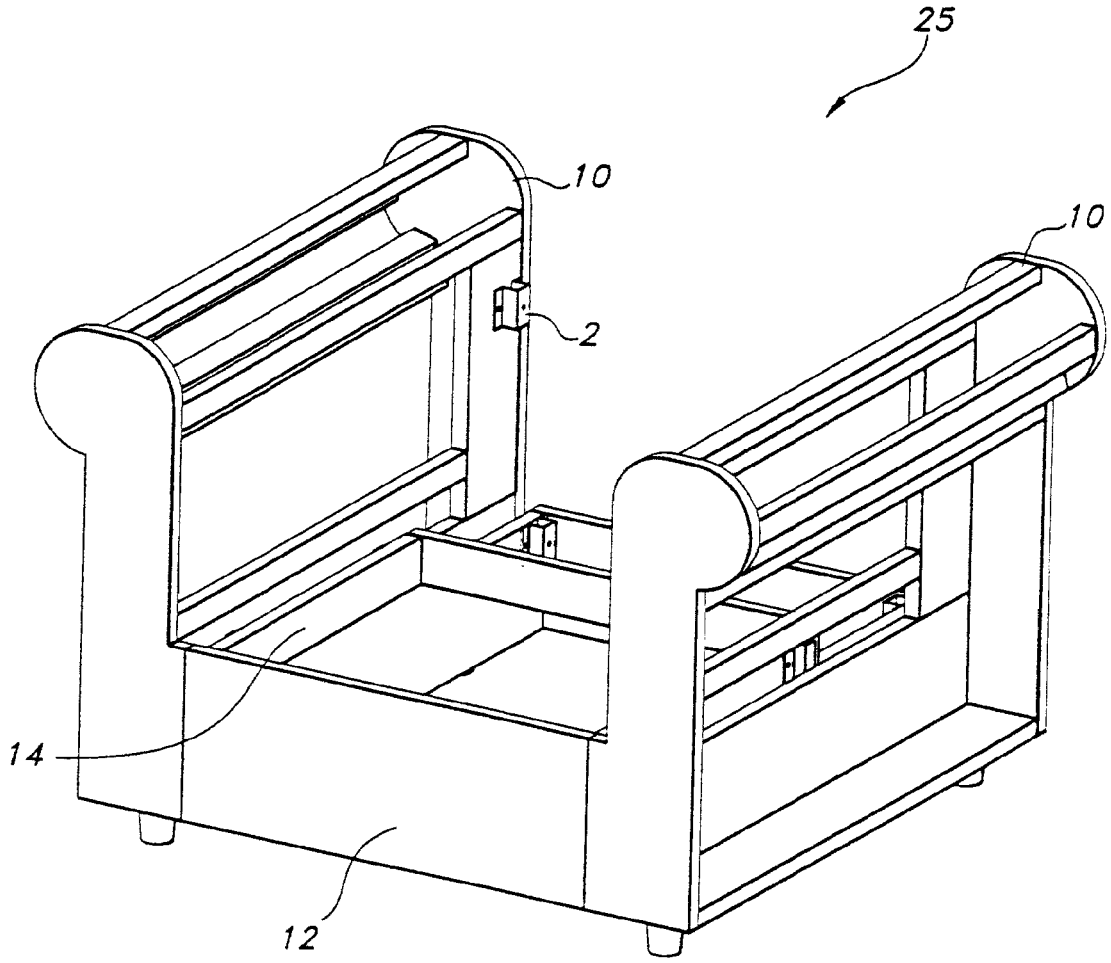
FIG. 7B shows the result achieved by the assembly of the seat component, the base component and two arm components.

FIG. 7B depicts the result achieved by the assembly of the seat component 14, the base component 12 and the two opposing arm components 10.

Figure 8:
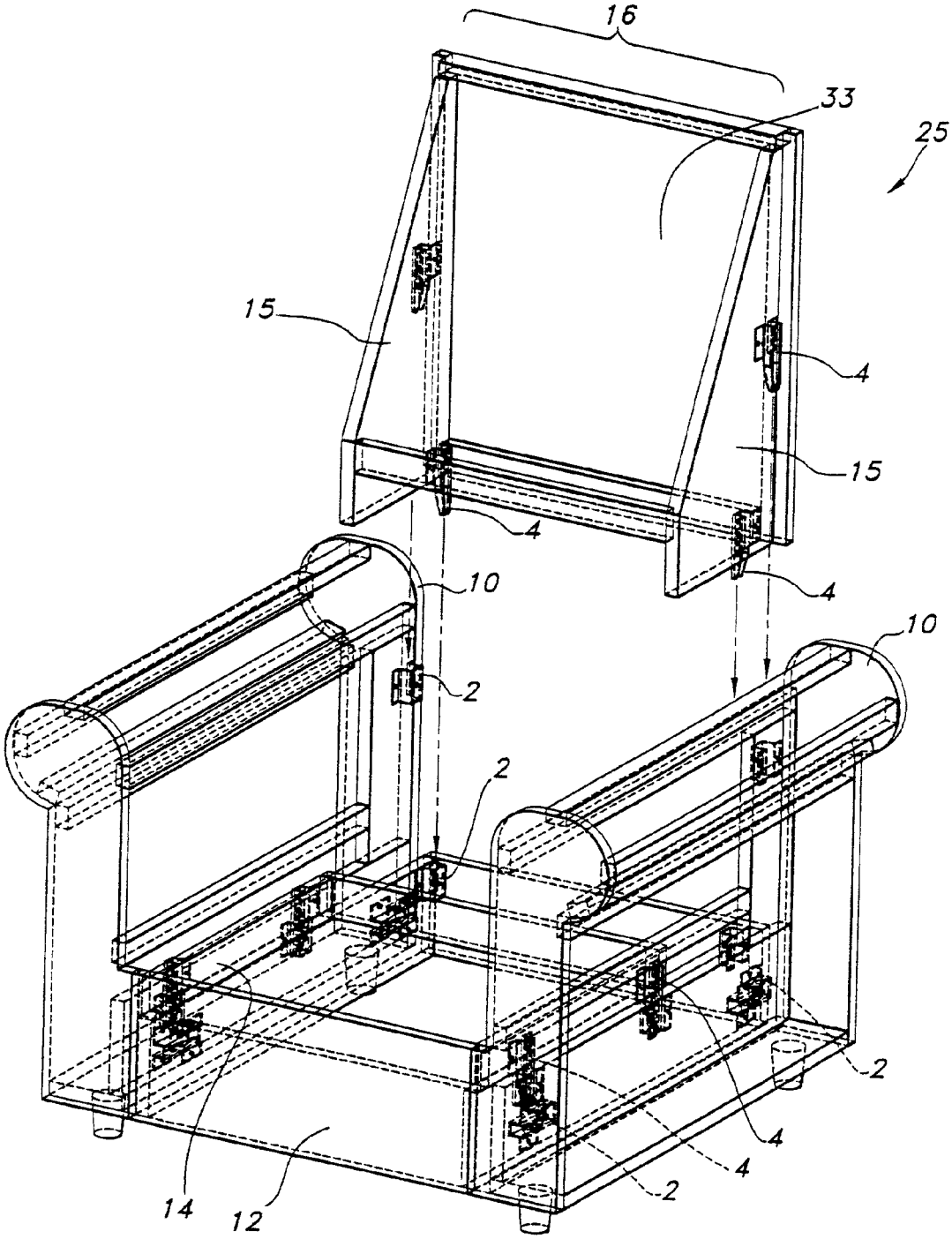
FIG. 8 shows a schematic view of the assembly process involving the back component and the result in FIG. 7B.

Referring to FIG. 8, the back component 16 is made of two side back panels 15. An engaging bracket 4 is vertically mounted on the exterior of each side back panels 15 near the middle section of each side back panel 15 allowing for the back component 16 to interconnect with the arm components 10 upon assembly. An engaging bracket 4 is vertically mounted on the interior of the side back panels 15 in the lower section of each side back panel 15 allowing for the back component 16 to lock with the base component 12 upon assembly. The back component 16 is further made of a back panel 33 that is substantially perpendicular and attached to the two side back panels 15.

Figure 9:
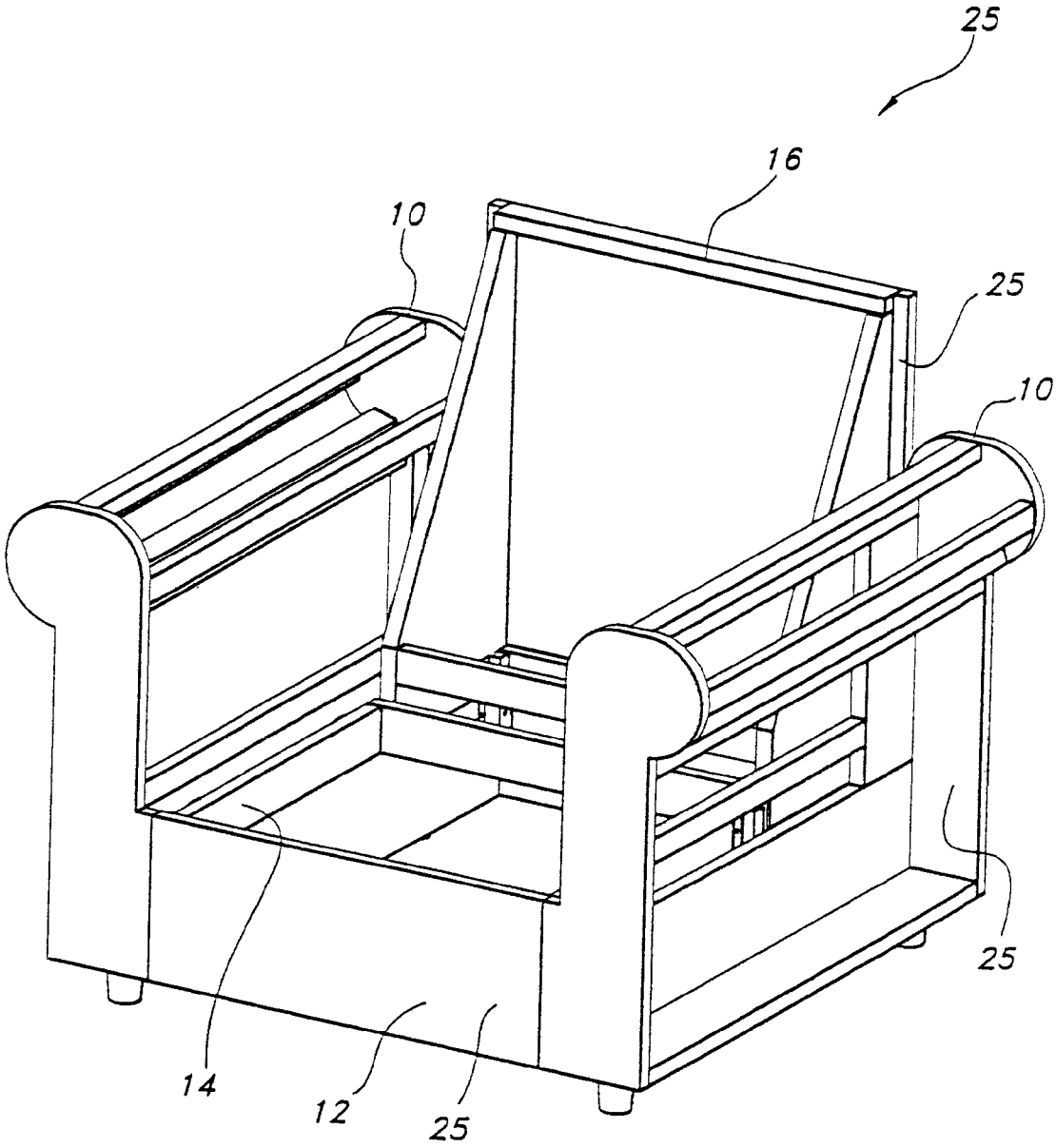
FIG. 9 shows the result achieved by the assembly of the back component, the seat component, the base component and two arm components.

FIG. 9 depicts the ready to assemble furniture piece 25. The ready to assemble furniture piece 25, a chair, is preferably made of furniture components 10, 12, 14 and 16 including the back component 16, the seat component 14, the base component 12 and two arm components 10. Each furniture component 10, 12, 14 and 16 is made of furniture panels 7, 8, 9, 13 and 15 which are preferably wooden but may be made of other materials, as desired by one skilled in the art. The furniture components can be upholstered, allowing the brackets to be attached to the exterior of the upholstery or can be upholstered when assembled.

The furniture components 10, 12, 14 and 16 are assembled by interconnecting the receiving brackets 2 and engaging brackets 4 which together form bracket assemblies 5. The number of bracket assemblies 5 used will vary depending on the styling of the furniture. At least one receiving bracket 2 or engaging bracket 4 is attached to furniture panels 7, 8, 9, 13 and 15 of each furniture component 10, 12, 14 and 16.

In relation to the presently illustrative configuration, it should be understood that the ready to assemble furniture piece 25 is readily adaptable to all types of furniture pieces including but not limited to sofas, sleepers, loveseats, chairs, and motion furniture. Moreover, the ready to assemble furniture piece is readily adaptable to most types and designs of furniture including but not limited to leather, fabric, show wood, loose cushion, single cushion, single back and split back. This system is not exclusively intended for upholstered furniture use, but can be used in other areas of the furniture industry, such as cabinets and tables.

Figure 10B:
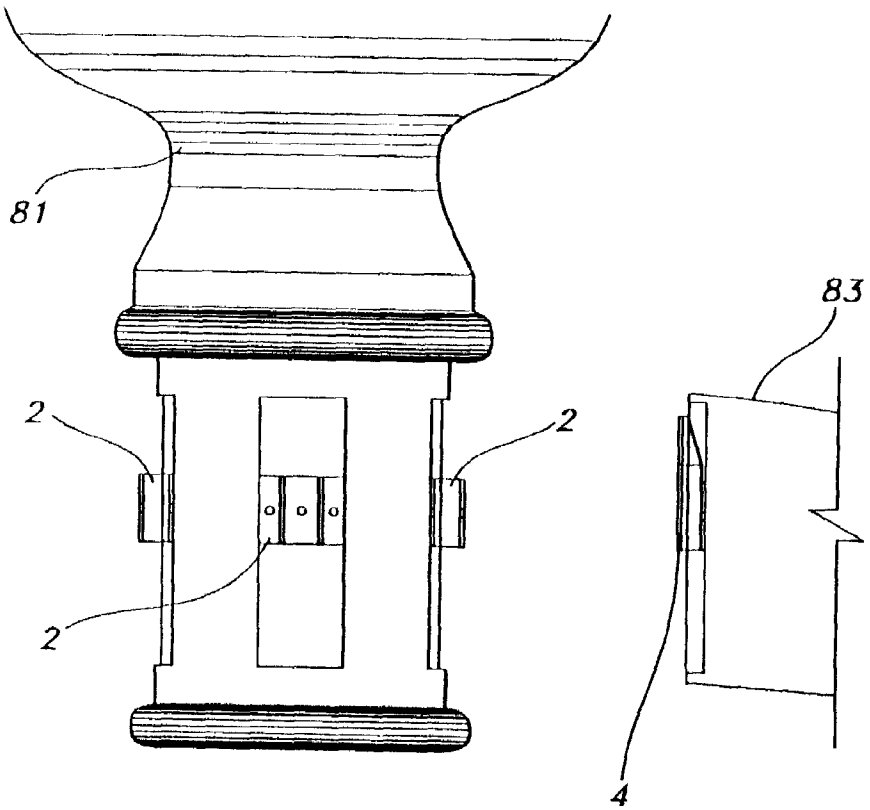
FIG. 10B shows a schematic view of a disconnected table support connector.
Figure 10A:
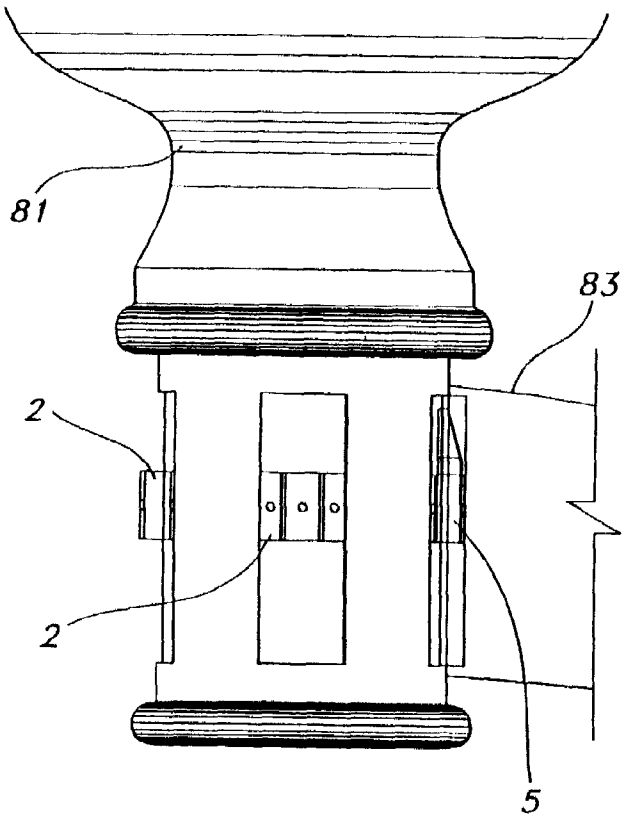
FIG. 10A shows a schematic view of a connected table support connector.

More specifically, as shown in FIGS. 10A and 10B a table support connection is shown. The table support 81 has a plurality of receiving brackets 2 attached around the table support 81. A table leg 83 has an engaging bracket 4 attached. The receiving bracket 2 and engaging bracket 4 are positioned to allow the table leg 83 to connect with table support 81.

In the preferred embodiment, there are four receiving brackets 2 attached equidistantly around the table support 81, but more or less brackets may be used as desired by one skilled in the art. The four receiving brackets 2 are connected to four engaging brackets 4 to affix the table legs 83 to a table support 81.

Figure 11A:
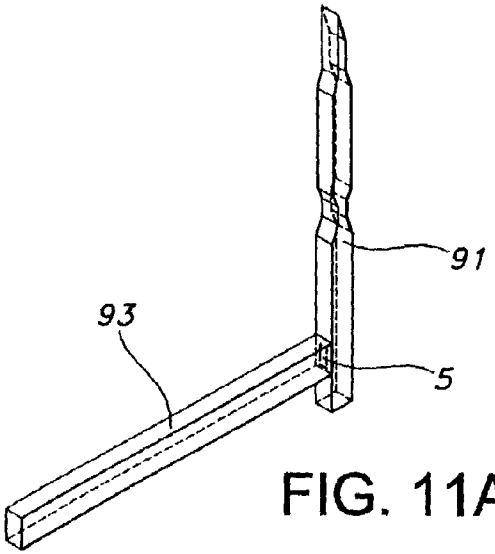
FIG. 11A shows a schematic view of a connected headboard and bedrail.
Figure 11D:
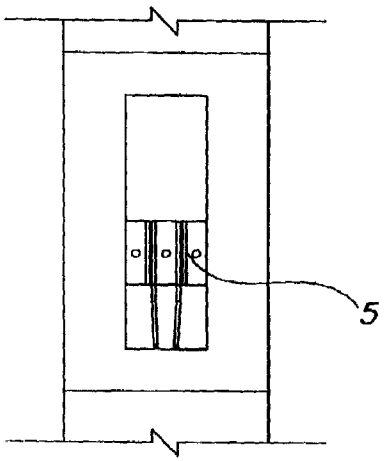
FIG. 11D shows a right schematic view of a headboard and bedrail.
Figure 11B:
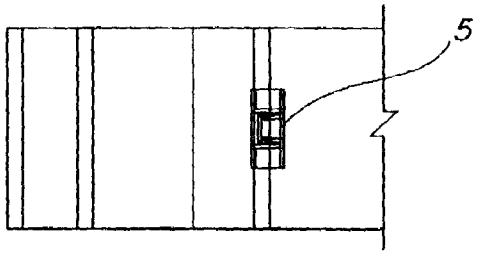
FIG. 11B shows a top schematic view of a headboard and bedrail.
Figure 11C:
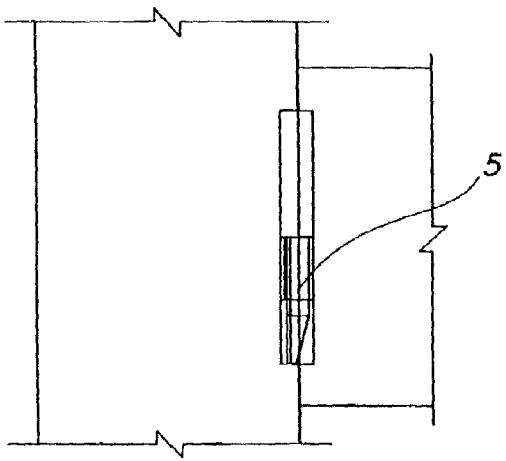
FIG. 11C shows a front schematic view of a headboard and bedrail.

Additionally, in FIGS. 11A-D, bedpost and bedrail connections are shown. In FIG. 11A, a bedrail 93 is attached by a bracket assembly 5 to a bedpost 91. FIGS. 11B-11D show cutaway sections of the connection viewed from above (FIG. 11B), the side (FIG. 1 IC) and along the axis of the bedrail (FIG. 11D).

Figure 12C:
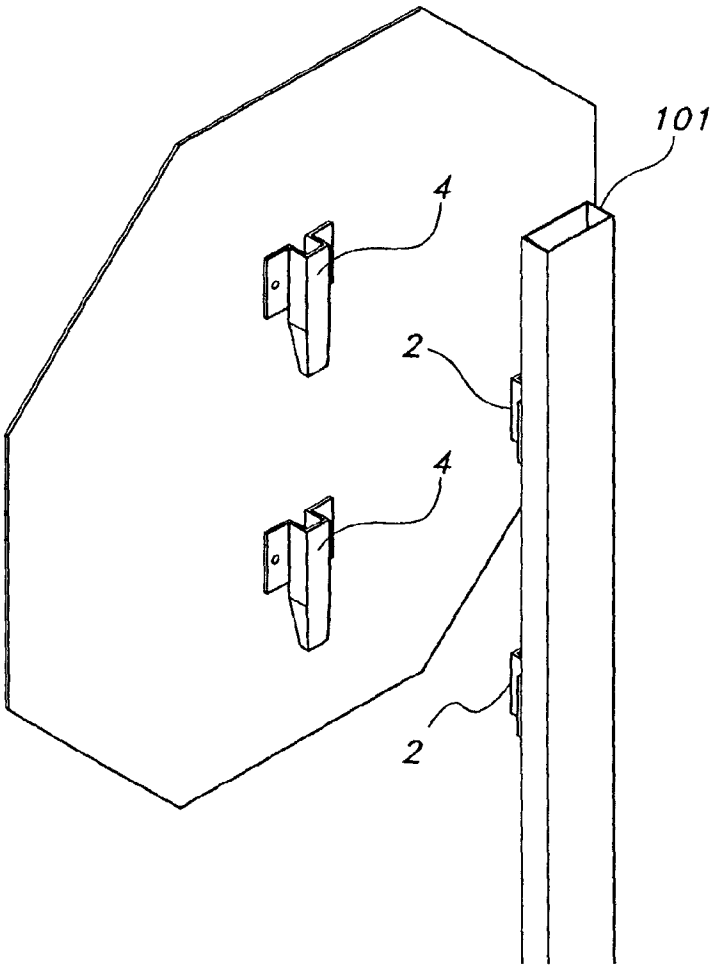
FIG. 12C shows a schematic view of a sign with engaging bracket and pole with receiving brackets.
Figure 12B:
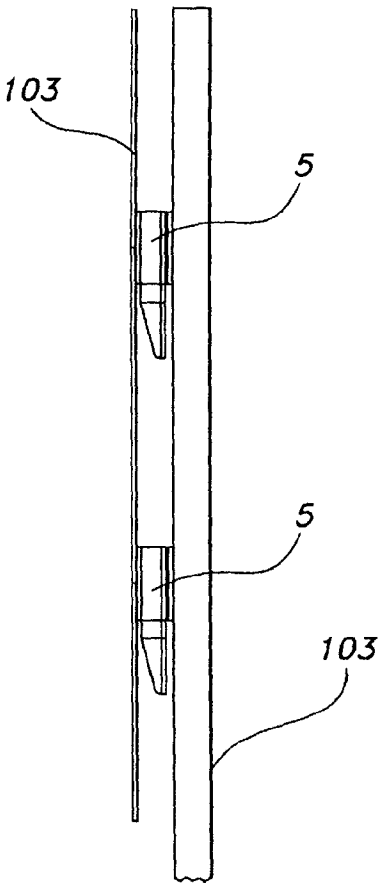
FIG. 12B shows a schematic side view of a sign connected to a pole via a bracket assembly.
Figure 12A:
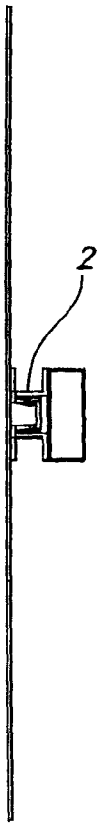
FIG. 12A shows a schematic side view of a receiving bracket and pole.

In FIGS. 12A, 12B and 12C, signage connection is shown. More specifically, a pole 101 has a receiving bracket 2 attached thereto. An engaging bracket 4 is attached to the back surface of a sign 103. The sign is attached to the pole 101 through bracket assembly 5.

Figure 13D:
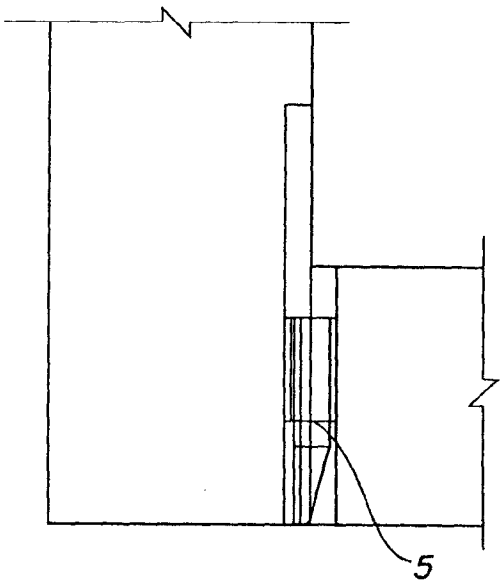
FIG. 13D is a schematic view of a portion of a casket.
Figure 13B:
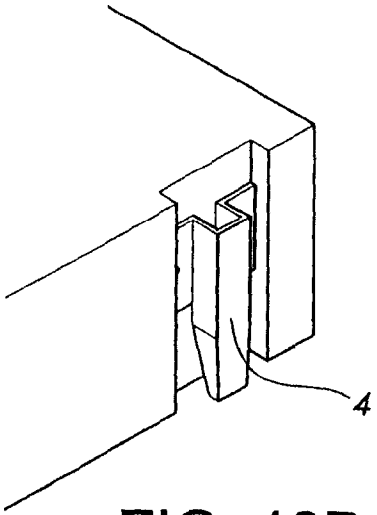
FIG. 13B is a schematic view of a portion of a casket.
Figure 13C:
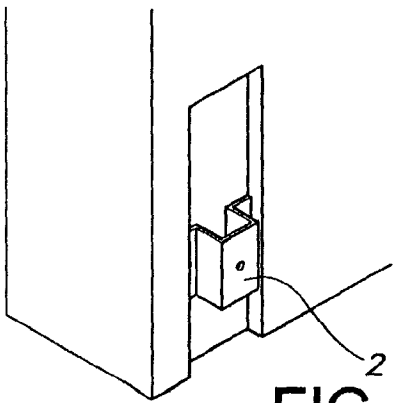
FIG. 13C is a schematic view of a portion of a casket.
Figure 13A:
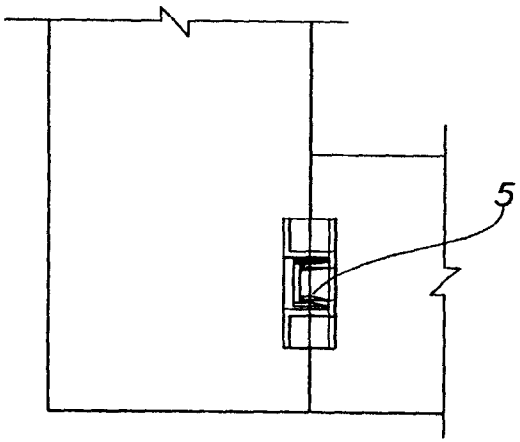
FIG. 13A is a schematic view of a portion of a casket.

Referring to FIGS. 13A-D, the receiving brackets 2 and engaging brackets 4 can be used to assemble a casket. In FIG. 13D, a bracket assembly 5 combines the components to form a casket.

The bracket assembly and system is advantageous because it allows the assembly of all types of furniture by a single individual. Moreover, the present invention is advantageous because it allows assembly at any place with no tools required for assembly and in approximately one to two minutes. Unlike present technology which is complicated and labor and part intensive, the self-assembly bracket and system has no loose parts to assemble. The required hardware for the present invention is only the receiving brackets 2 and engaging brackets 4 placed at integral parts on the ready to assemble furniture piece 25.

Although the forgoing invention has been described in some detail by way of illustration and example for purposes of clarity of understanding, it will be obvious that certain changes and modifications can be made which are within the full scope of the invention.

We claim:

1. A method comprising the steps of:

(a) attaching at least one engaging bracket to a plurality of first like furniture components wherein said at least one engaging bracket comprises an elongated riser wherein said elongated riser is comprised of two spaced apart vertical members and is substantially perpendicular to a plurality of flanges and a top member, said elongated riser connected to said plurality of flanges to form a line of intersection, wherein said elongated riser extends beyond said plurality of flanges to form a cantilevered projection, said cantilevered projection comprising a first portion and a second portion, said first portion extending substantially parallel to said line of intersection and said second portion tapering along the vertical members;

(b) attaching at least one receiving bracket to a plurality of second like furniture components, wherein said at least one receiving bracket comprises a riser having an inner surface and an outer surface and a plurality of flanges wherein said first portion of said cantilevered projection of said at least one engaging bracket is configured to contact the inner surface of said at least one receiving bracket, wherein said at least one receiving bracket is positioned to interconnect with said at least one engaging bracket.

2. The method of claim 1, further comprising the step of transporting said plurality of first like furniture components.

3. The method of claim 1, further comprising the step of transporting said plurality of second like furniture components.

4. The method of claim 1, further comprising the step of interconnecting a first like furniture component having said at least one engaging bracket with a second like furniture component having said at least one receiving bracket to assemble furniture without the use of tools.

* * * * *